US005199920A

United States Patent [19]

Christen

[11] Patent Number: 5,199,920

[45] Date of Patent: Apr. 6, 1993

[54] AMUSEMENT DEVICE WITH VIBRATED HANDLE

[75] Inventor: Richard P. Christen, Sandy, Oreg.

[73] Assignee: Hart Enterprises, Inc., Vancouver, Wash.

[21] Appl. No.: 901,772

[22] Filed: Jun. 22, 1992

[51] Int. Cl.[5] ..... A63H 5/00

[52] U.S. Cl. ..... 446/419; 446/484

[58] Field of Search ..... 446/419, 418, 420, 421, 446/484, 411, 3, 144, 145, 479, 259, 236, 241, 268; 128/36

[56] References Cited

U.S. PATENT DOCUMENTS 4,713,039 12/1987 Wong ..... 446/484 X

FOREIGN PATENT DOCUMENTS 441354 3/1927 Fed. Rep. of Germany ..... 446/419

2254185 7/1985 France ..... 446/268

*Primary Examiner*—Mickey Yu

*Attorney, Agent, or Firm*—Kolisch, Hartwell, Dickinson, McCormack & Heuser

[57] ABSTRACT

An amusement device including an elongate handle and a chamber defined at each of the opposite ends of the handle. An eccentric weight rotated under power is located in one chamber, and rotation of the weight produces vibrations in the device. Loose material composed of relatively movable members is confined within the other chamber. The loose material is set in motion with vibrations produced in the device.

6 Claims, 1 Drawing Sheet

AMUSEMENT DEVICE WITH VIBRATED HANDLE

BACKGROUND AND SUMMARY OF THE INVENTION

This invention relates to an amusement device or toy, and, in particular, to a device or toy which is hand held, in the manner of a conventional infant rattle, the device including power-operated means operable when actuated to produce visual, audio, and/or sensory effects which entertain the infant user.

A toy as contemplated by this invention includes a handle, and an electrically powered vibration producer mounted on the handle in a suitable manner, which, in a preferred embodiment, is at one end of the handle. The toy further includes structure forming a chamber mounted on the handle, normally, and in a preferred embodiment, at the end of the handle opposite the end having the vibration producer. Loose material confined within this chamber is set in motion with actuation of the vibration producer. The loose material may take the form of beads or other objects producing a rattling noise, or visual effects, or both, with random motion imparted to the members of the material. Additionally, a sensory feeling is produced, by reason of the vibrations that are produced in the handle through the action of the vibration-producing means.

A general object of the invention therefore is to provide a new and improved form of hand-held toy.

More specifically, an object is provide a new hand-held toy usable, for instance, by an infant, which includes a vibration producer, and material confined within a space on the toy set in motion by the vibration producer.

In a more specific and preferred embodiment, the toy is battery operated, and includes a handle with a vibration producer at one end and a chamber confining loose material at the other end. The vibration producer when operated produces vibrations imparted to the chamber setting the loose material in motion. The handle itself may be used for housing a battery or batteries usable as the source of electrical energy, and an electric motor which powers the vibration producer.

BRIEF DESCRIPTION OF THE DRAWINGS

These and other objects and advantages are attained by the invention, which is described hereinbelow in conjunction with the accompanying drawings, wherein.

DETAILED DESCRIPTION OF A PREFERRED EMBODIMENT

Figure 1:
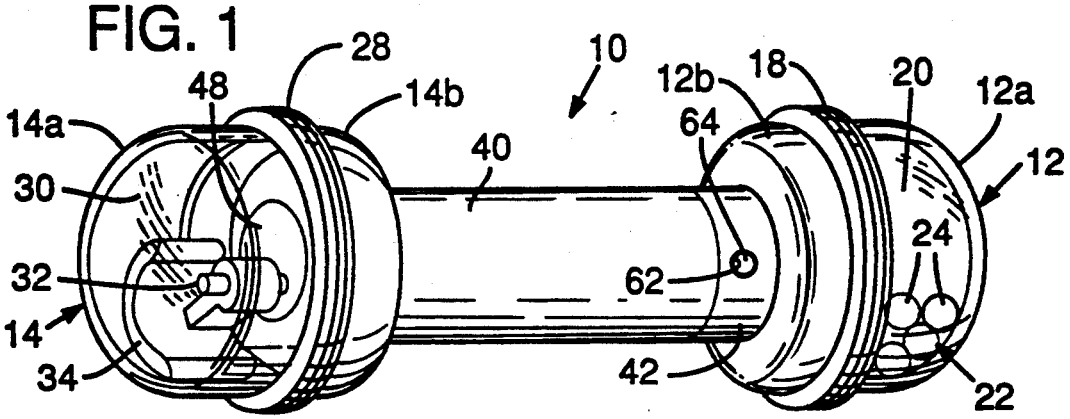
FIG. 1 is a perspective view illustrating the invention.

Referring now to the drawings, the toy illustrated includes an elongate handle, indicated generally at 10. Mounted on each of the ends of the handle and giving a symmetrical appearance to the toy, is a dome. These domes for the respective ends of the toy have been given the reference numbers 12 and 14. The domes may have a similar construction. In the embodiment illustrated, each dome includes an outer section of clear material such as clear plastic, shown for the two domes at **12*a* and 14*a*. Completing each dome is an inner section, which may conveniently be made of a frosted plastic material, and these inner sections are indicated for the respective domes at 12*b* and 14*b***.

Considering initially dome 12 and related structure, outer section **12*a* is secured to the inner section through a wall 18. Wall 18 and the curving wall of the outer dome section together constitute a first chamber structure, and define a chamber 20 located beyond one end of the handle. Confined within this chamber is a mass 22 of loose material, more particularly a mass made up of plural members permitted relative motion with respect to each other, and exemplified in the drawing by beads 24. The beads may be made of a hard material, and with dome 12** vibrated or oscillated, random motion is produced in the beads confined in the chamber. A hard construction selected for the beads results in a rattling noise, produced by the beads striking each other and the walls which define the chamber. For an interesting visual effect, these beads may be given different distinctive colors.

Dome 14 at the opposite end of the handle includes and annular ring 28 fixedly joined between sections **14*a*, 14*b*. The inner surfaces of sections 14*a*, 14*b* constitute another chamber structure defining an enlarged chamber 30**. This chamber contains a power-rotated eccentric mechanism which, when actuated, produces oscillations or vibrations of the toy.

Specifically, protruding into chamber 30 is a power-rotated shaft 32. Mounted on this shaft in an offset or eccentric position is a weight member 34. With the shaft rotated, the eccentrically disposed weight member 34 is spun rapidly about the axis of shaft 32. This results in rapid oscillations or vibrations being imparted to the shaft and its mounting.

With the weight member being visible within chamber 30 by reason of the clear plastic outer dome section **14*b***, the infant user is provided with another source of interest when utilizing the toy.

Shaft 32 is rotated with energizing of an electric motor mounted within the handle of the toy. Also mounted within the handle of the toy is one or more batteries, and circuitry is provided connecting the battery with the motor whereby the motor may be selectively operated. Details of these features will now be discussed.

Figure 2:
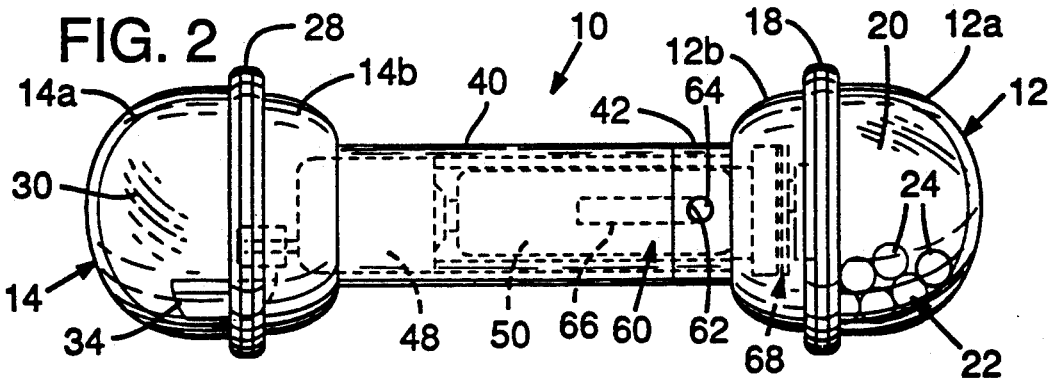
FIG. 2 is a side view of the device illustrated in FIG. 1 further illustrating details of construction.
Figure 3:
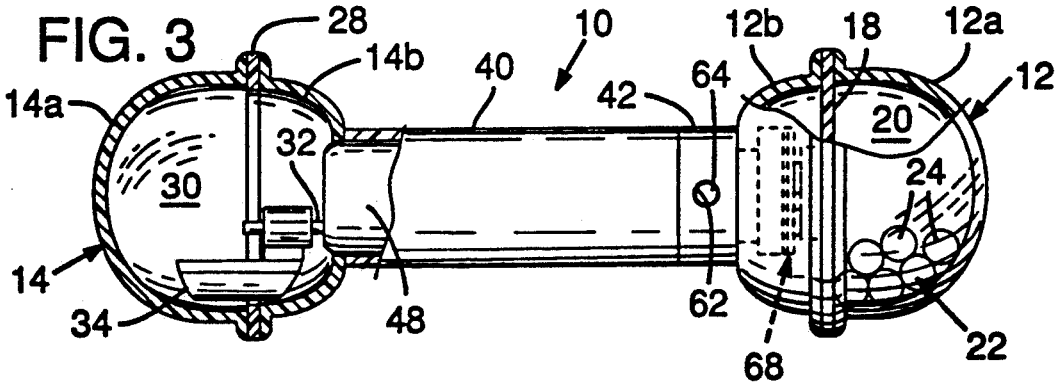
FIG. 3 is a side view, partially broken away.
Figure 4:
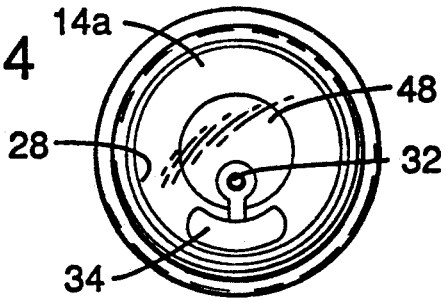
FIG. 4 is an end view viewing the left end of the device as illustrated in FIGS. 1 through 3.

As can be seen with references to FIG. 2, handle 10 is made up of a pair of hollow tube section 40, 42 disposed end-to-end, and suitably intersupported whereby one mounts the other. Sections 40, 42 provide a hollow interior to the handle. This interior space is utilized in the mounting of an electric motor shown at 48, and a battery 50 which provides the source of electrical energy to actuate the motor. The rotor of motor 48 is connected to shaft 32 so that on operation of the motor the shaft is rotated.

Securing section 40 to section 42 is an indent-detent means shown at 60. Specifically, a bore 62 (or indent) is provided in the wall of section 42. Seated within this bore is ball (or detent) 64. Detent 64 is secured to the end of a spring member 66 having its opposite end secured to section 42. The construction provides a relatively child-proof manner for securing the two sections together. With depressing of the detent to free it from bore 62, sections 40, 42 may be displaced from each other to provide access to the battery which is housed within the handle.

The toy includes circuitry actuatable to close a circuit between the battery and motor to provide for selective control of motor operation. Specifically, a switch means is indicated generally at 68. Inner dome section **12*b* is relatively rotatably on handle section 40**. The relatively rotatable dome section is connected to the switch means is such a manner that rotation of the dome section serves to open and close the switch means as required.

Describing how the toy may be used, actuation of switch means 68 causes motor 48 to be dictated producing powered rotation of shaft 32 and spinning of the weight member about the axis of the shaft. This produces rapid, oscillations or vibrations in the motor and the handle housing the motor. These vibrations are sensed by the hand of the user, producing a tingling sensation. The rotating eccentric at one end of the toy visible through clear outer section **14*a*** provides visual interest to the user. In addition, the members of the loose mass of material confined within the chamber or the opposite end of the toy are set in random motion by the vibrations produced. Visual and sound effects result from this random motion, as earlier described.

While a specific embodiment of the invention has been described, obviously modifications and variations are possible.

It is claimed and desired to secure by Letters Patent:

1. An amusement device comprising:

a handle adapted to be gripped in the hand of the user, chamber structure joined to the handle and having walls defining an enclosed chamber, a motorized vibration producer mounted on the handle producing on actuation vibrations which are transmitted to the handle and thence to said chamber structure, and loose material composed of a series of members free to move with respect to each other confined in said chamber, the members of said material being set in random motion with actuation of the vibration producer.

2. The amusement device of claim 1, wherein said vibration producer comprises an eccentric mechanism producing orbital movement of said handle.

3. The amusement device of claim 1, wherein said loose material comprises unjoined members producing a noise when set in random motion.

4. The amusement device of claim 1, wherein said vibration producer comprises motor-operated eccentric mechanism located in a region disposed beyond one end of the handle, and wherein said chamber structure is located at a region disposed toward the opposite end of the handle.

5. The amusement device of claim 1, wherein said handle is elongate and has opposite ends, said chamber structure is joined to one of said opposite ends of the handle, and which further includes another chamber structure joined to the other of said opposite ends of the handle having walls defining another chamber, said motorized vibration producer including an eccentric rotatable weight disposed within said other chamber, said handle housing an electric motor for rotating said eccentric weight under power and a battery for supplying energy to said motor.

6. An amusement device comprising:

an elongate handle, first chamber structure joined to one end of the handle with walls defining a first chamber, second chamber structure joined to the opposite end of the handle with walls defining a second chamber, a power-driven shaft extending into the second chamber, and an eccentric weight mounted on said shaft eccentric with the shaft, an electric motor mounted within said handle operatively connected to and driving said shaft, a battery mounted within said handle electrically connected to said motor providing energy for running the motor, and loose material composed of plural relatively movable members disposed in said first chamber and set in random motion with actuation of the eccentric weight.

* * * * *